US006247807B1

(12) United States Patent
Yang et al.

(10) Patent No.: US 6,247,807 B1
(45) Date of Patent: Jun. 19, 2001

(54) INK-JET CARTRIDGE

(75) Inventors: Ming-Hsun Yang; Huan-Kun Chen; Ji-Chen Wu, all of Hsinchu (TW)

(73) Assignee: WiserTek International Corp., Hsinchu (TW)

( * ) Notice: Subject to any disclaimer, the term of this patent is extended or adjusted under 35 U.S.C. 154(b) by 0 days.

(21) Appl. No.: 09/405,068

(22) Filed: Sep. 27, 1999

(51) Int. Cl.[7] ..... B41J 2/175

(52) U.S. Cl. ..... 347/87; 347/86

(58) Field of Search ..... 347/84, 85, 86, 347/87

(56) References Cited

U.S. PATENT DOCUMENTS 5,040,002 * 8/1991 Pollacek et al. ..... 347/87
5,409,134 4/1995 Cowger et al. ..... 347/87
5,682,189 * 10/1997 Takagi ..... 347/87

* cited by examiner

*Primary Examiner*—N. Le
*Assistant Examiner*—Anh T. N. Vo
(74) *Attorney, Agent, or Firm*—Birch, Stewart, Kolasch & Birch, LLP

(57) ABSTRACT

An ink-jet cartridge for an ink-jet pen is disclosed. The cartridge includes a back pressure chamber in which the level of ink will be self-adjusted to provide ink for ejection and prevent ink from leakage. The ink-jet cartridge includes an ink reservoir for storing ink, a back pressure chamber, a print ink chamber and a print head. The back pressure chamber has one end fluid-communicated with the ink in the ink reservoir, and the other end fluid-communicated with the print ink chamber via an overflow vent which is at a position higher than the ink level of the ink reservoir. A suitable back pressure is applied to the back pressure chamber and the print ink chamber so that, when printing, the increased back pressure in the print ink chamber sucks ink from the ink reservoir through the overflow vent into the print ink chamber; while, when not printing, the extra height of the ink in the back pressure chamber relative to the ink level of the reservoir balances the back pressure at the back pressure chamber and the print ink chamber to prevent ink leakage from the print head. Therefore, it doesn't need a valve or a movable element to accomplish the ink supply and leakage prevention.

19 Claims, 5 Drawing Sheets

INK-JET CARTRIDGE

BACKGROUND OF THE INVENTION

1. Field of the Invention

This invention relates to an ink-jet cartridge for regulating the ink pressure within the ink reservoir of an ink-jet pen. The cartridge automatically controls the pressure difference inside and outside to prevent ink from leakage.

2. Related Art

In ink-jet printing, the common types of ink-jet control are heat bubble and piezoelectric pressure wave methods. A heat bubble type print head includes a thin-film resistor that is heated to cause sudden vaporization of a small portion of the ink. The rapid expansion of the ink vapor forces a small amount of ink through a print head orifice to a printing paper. Although conventional print heads are effective for ejecting ink drops from a reservoir, they need extra mechanisms for preventing ink from permeating through the print head when the print head is inactive. The common mechanism provides a slight back pressure at the print head to prevent ink leakage from the print head whenever the print head is inactive. The term "back pressure" used herein means the partial vacuum within the reservoir that resists the flow of ink through the print head. Back pressure is considered in the positive sense so that an increase in back pressure represents an increase the partial vacuum.

In the design of an ink-jet cartridge, the following requirements should be considered:

a) the back pressure at the print head must be at all times strong enough for preventing ink leakage. But the back pressure must not be so strong that the print head is unable to overcome the back pressure to eject ink droplets, or the size of the ink droplets and the print quality are influenced;

b) the back pressure at the print head must be varied according to the pressure of environment and maintained in a suitable range, for example, when the pressure of environment drops, the back pressure must be relatively higher to prevent ink leakage; and c) the operating effect of the ink reservoir also influences the back pressure at the ink-jet cartridge. That is, the back pressure raises when the ink is used up, therefore, it must be suitably regulated to assure the ink ejection. Without regulation of this back pressure increase, the ink-jet pen will eventually fail because the print head will be unable to overcome the increased back pressure to eject ink drops.

In the current arts, the back pressure of the ink reservoir is regulated by an accumulator. The accumulator is generally an elastic bag varying its volume between a minimum volume position and a maximum volume position to regulate the ink reservoir volume and adjust the back pressure so that the back pressure remains within an operating range that is suitable for preventing ink leakage while permitting the print head to continue ejecting ink droplets.

As shown in FIG. 1, an accumulator 20 for an ink-jet cartridge 1 is disclosed by U.S. Pat. No. 5,409,134. The ink-jet cartridge 1 includes a reservoir 10 which has a rigid body 11 and a print head 30 located at the bottom of the reservoir 10 for providing ink 40 to the print media through a print head 30. An accumulator 20 mounted inside the reservoir 10 and includes mainly a spring 21*a*, 21*b*; an expandable bag 22*a*, 22*b* which is formed of two thin flexible sheets 23, 24. The bag 22*a*, 22*b* is fastened via a fitment 25 having pins 27 and release patch 26 to the top of the rigid body 11, and a breather strip 28 fixed between the flexible sheets 23, 24 so that the interior of the bag 22*a*, 22*b* is in fluid communication with the ambient air through a duct 12. With the accumulator 20 in place, the reservoir 10 is filled with ink 40 through an unshown sealable port. A slight back pressure is established within the reservoir 10. The slight back pressure is the minimum amount of back pressure necessary to keep ink from leaking through the print head 30 when the print head is inactive.

As the cartridge 1 is used for printing, the air pressure within the reservoir 10 decreases (hence, the back pressure increases) as ink 40 is depleted. During printing, the bag 22*a*, 22*b* expands as a result of the back pressure increase. The bag expansion decreases the volume of the reservoir 10 to maintain the reservoir back pressure within a range such that the print head 30 is able to continue ejecting ink 40 from the reservoir 10. If the ambient pressure should thereafter decrease (for example, during air transport of the cartridge), the bag 22*a*, 22*b* will contract to increase the reservoir volume so that the back pressure within the reservoir 10, relative to ambient, does not drop to a level that permits ink 40 to leak from the print head 30.

SUMMARY OF THE INVENTION

The primary object of the present invention is to provide an ink-jet cartridge which doesn't need a valve or a movable element to adjust the back pressure within the reservoir. The cartridge includes a back pressure chamber in which the level of ink will be self-adjusted to provide ink for ejection and prevent ink from leakage when the ambient air pressure drops.

The ink-jet cartridge according to the present invention includes:

an ink reservoir for storing ink and providing ink for ejection, the reservoir includes:

a rigid body, formed with rigid material, for storing ink;

a vent, located on top of the rigid body, communicated with the ambient air, for adjusting the air pressure inside the ink reservoir;

a print head for ejecting ink and printing;

a print ink chamber for preparing ink ready for the print head, the ink level of the chamber is normally lower than the ink level of the rigid body; and a back pressure chamber, having one end fluid-communicated with the ink in the rigid body, and the other end fluid communicated with the print ink chamber via an overflow vent which is at a position higher than the ink level of the rigid body, a suitable back pressure is applied to the back pressure chamber and the print ink chamber so that, when printing, the increased back pressure at the print ink chamber sucks ink from the ink reservoir through the overflow vent into the print ink chamber; while, when not printing, the extra height of the ink in the back pressure chamber relative to the ink level of the ink reservoir balances the back pressure at the back pressure chamber and the print ink chamber to prevent ink leakage from the print head.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The objectives and advantages of the present invention will become more apparent from the following detailed description of preferred embodiments with reference to the accompanied drawings which are given by way of illustration only, and thus are not limitative of the present invention, and in which.

DETAILED DESCRIPTION OF PREFERRED EMBODIMENTS

Figure 3:
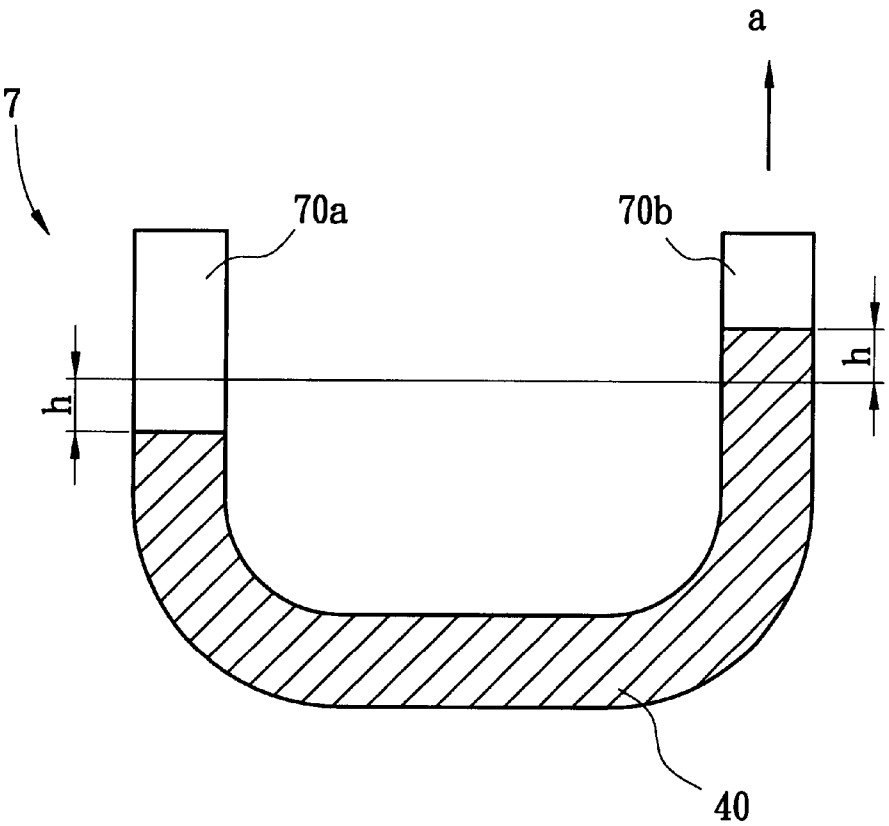
FIG. 3 is an explanatory diagram showing the levels of liquid in a U-tube where a back pressure is applied at one end thereof.

The primary object of the present invention is to provide an in-jet cartridge which doesn't need a valve or a movable element to adjust the back pressure within the reservoir. FIG. 3 is an explanatory diagram showing a principle of the present invention in which a liquid stays in a U-tube, and a back pressure is applied at one end thereof.

The liquid or ink 40 flows in a U-tube 7 will balance the levels in the left and right ends 70*a*, 70*b* as the fluid principle if the U-tube 7 is not influenced by other force. If the right end 70*b* is vacuumed as shown with the arrow "a", i.e., applied with lower pressure, the liquid level at the right end 70*b* will be higher than that at the left end 70*a* to balance the pressure. The raised height "h" of the liquid at the right end 70*b* from a neutral level is the same as the lowered height "h" of the liquid at the left end 70*a* from the neutral level.

Figure 1:
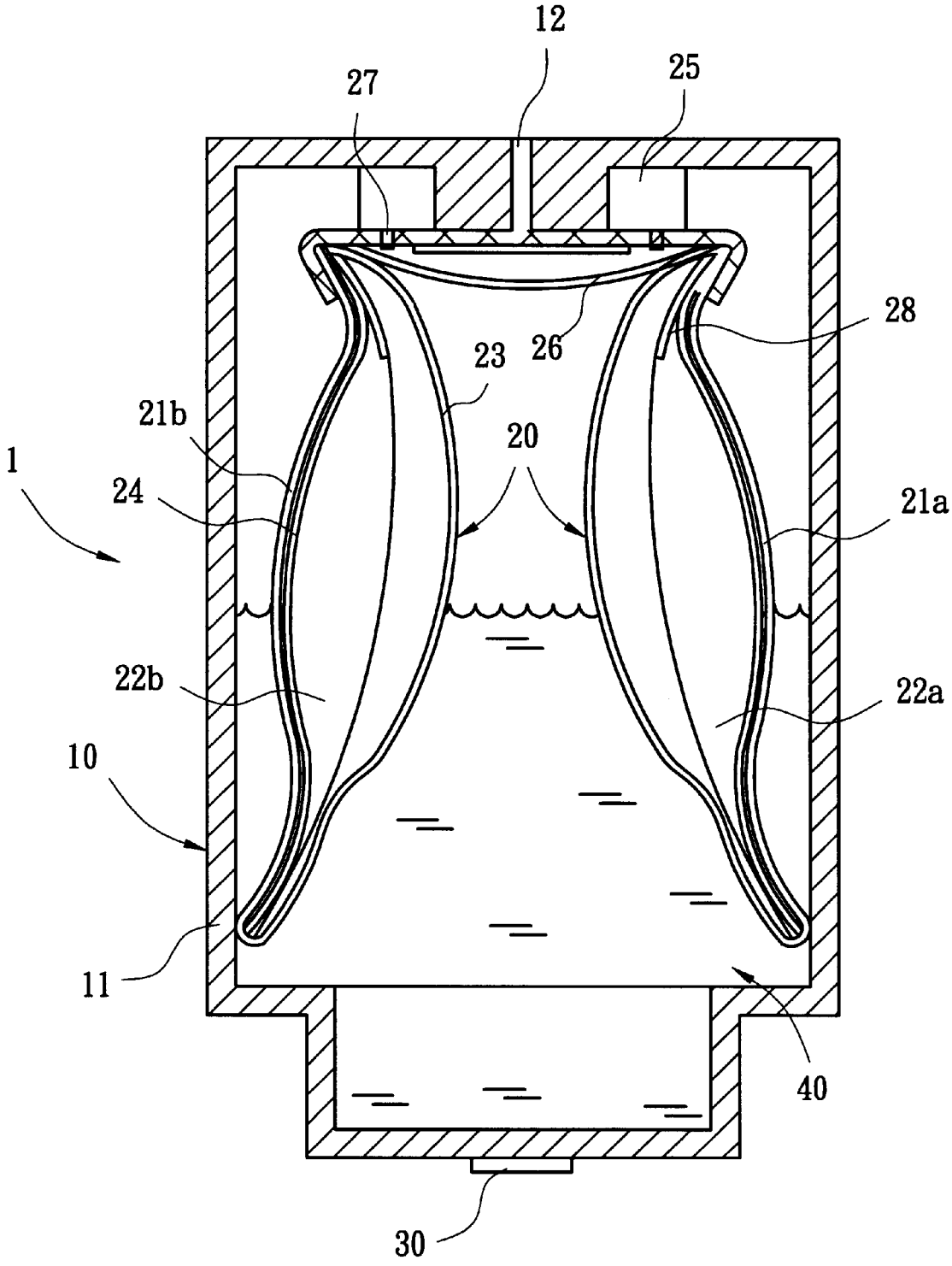
FIG. 1 (Prior Art)
FIG. 1 is a sectional view of a related art ink-jet cartridge in which an expandable bag is expanded when the back pressure at the ink reservoir increases.
Figure 2:
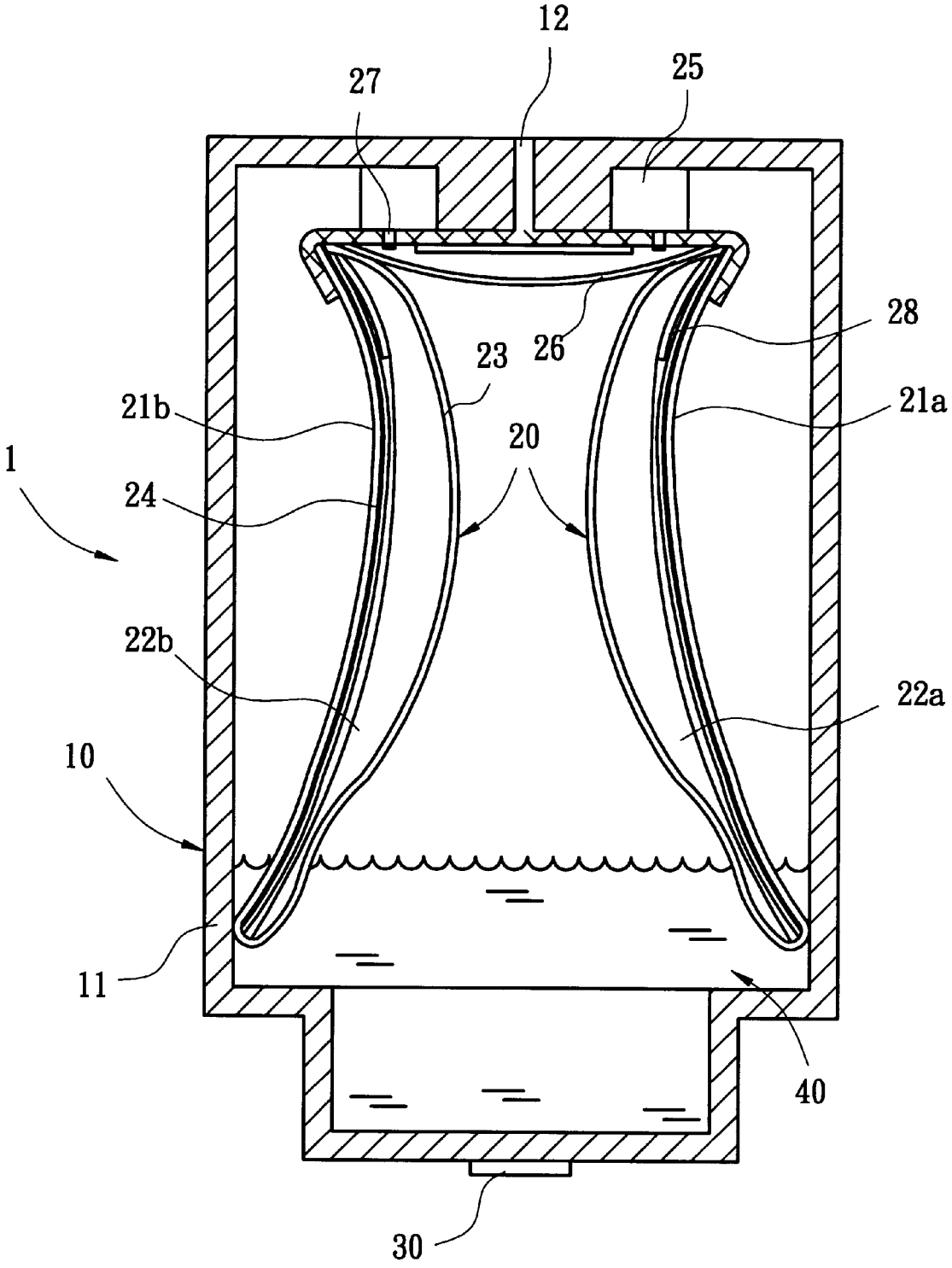
FIG. 2 (Prior Art)
FIG. 2 is a sectional view of the ink-jet cartridge of FIG. 1 in which the expandable bag is shrunk when the ambient pressure lowers.
Figure 4:
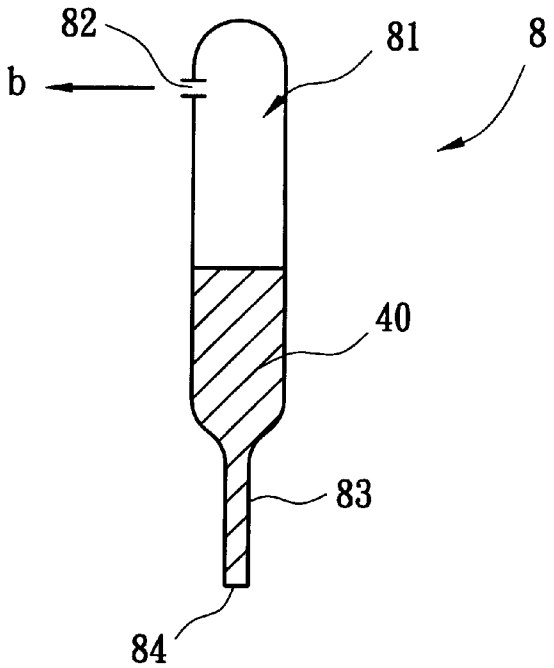
FIG. 4 is an explanatory diagram showing a nozzle and the ink stored therein which is held by a back pressure.

FIG. 4 is an explanatory diagram showing a second principle of the present invention in which a nozzle of ink ejector 8 and the ink stored therein is held by a back pressure.

The ink 40 is stored in the ink ejector 8 which includes a chamber 81 as the main body; a neck 83 and a nozzle 84 formed at the bottom of the chamber 81 for ejecting ink 40. A suction port 82 is formed on the wall of the chamber 81 for vacuuming.

The ink 40 in the ink ejector 8 will normally flow through the nozzle 84 by its own weight. Upon being vacuumed at the suction port 82 to decrease the pressure in the chamber 81 and to overcome the weight of the ink 40, the ink 40 can be kept in the chamber 81 and prevented from leakage through the nozzle 84.

First Embodiment

Figure 5:
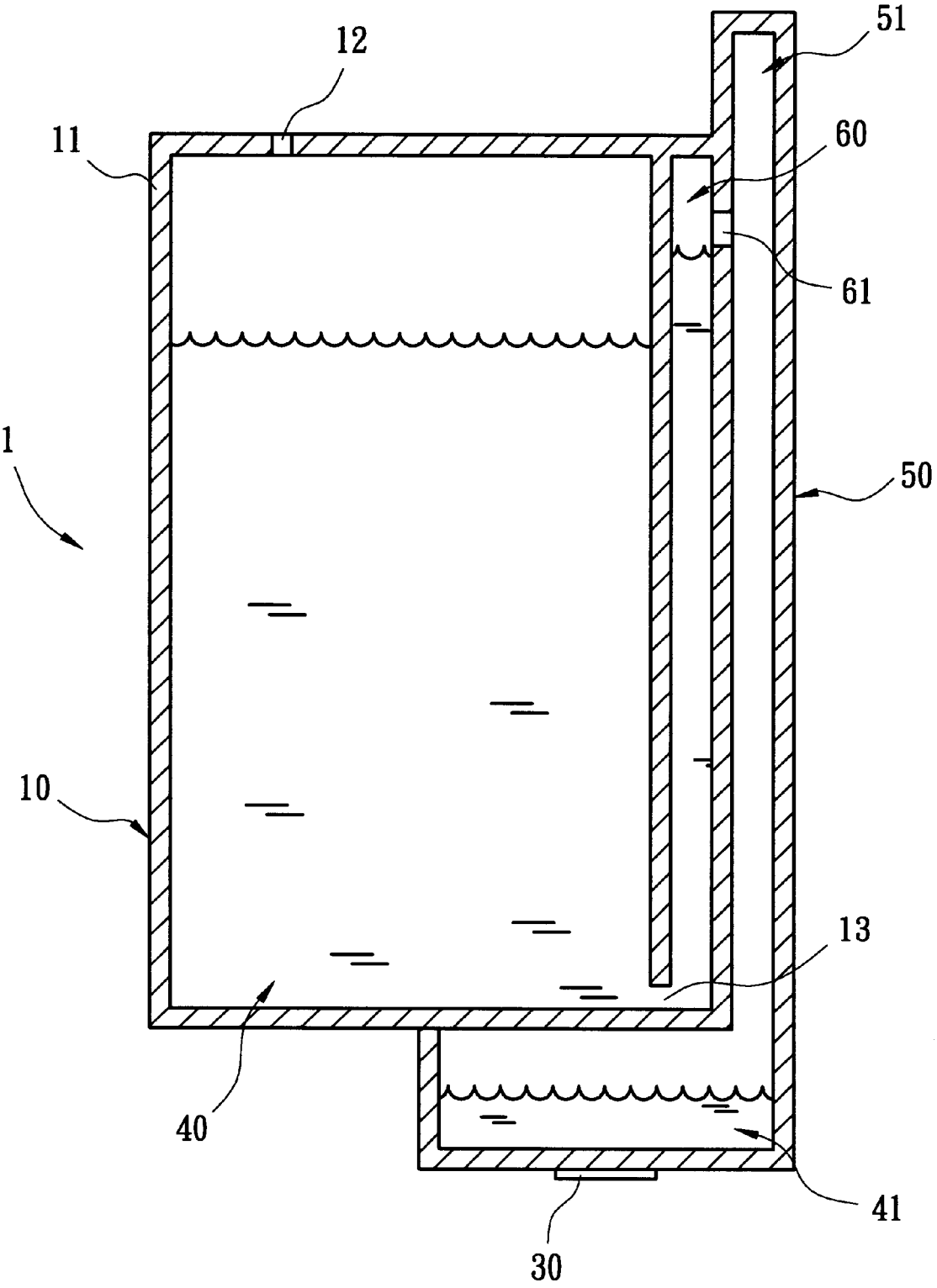
FIG. 5 is a first embodiment of an ink-jet cartridge according to the present invention.

FIG. 5 is a first embodiment of an ink-jet cartridge according to the present invention. The ink-jet cartridge 1 includes:

an ink reservoir 10 for storing ink 40 and providing ink 40 for ejection, the reservoir 10 includes:

a rigid body 11, formed with rigid material, for storing ink 40;

a vent 12, located on top of the rigid body 11, communicated with the ambient air, for adjusting the air pressure inside the ink reservoir 10. The vent 12 can be a one-way penetrable film which permits ambient air passing into the reservoir 10, but forbids the ink 40 leaking from the reservoir 10;

a print head 30 for ejecting ink 40 and printing. The ink 40 ejected from the print head 30 is forced by pressurizing means such as an unshown piezoelectric element or by heating and vaporizing means such as a heat generator;

a print ink chamber 50 for preparing ink ready for the print head 30, the level of ink 41 in the chamber 50 is normally lower than the level of ink 40 in the ink reservoir 10. The chamber 50 is also formed with a room S1 for containing the ink 41 and preventing the ink 41 from flowing back to a back pressure chamber 60 when the ink-jet cartridge is inclined or turned over; and a back pressure chamber 60, having one end fluid-communicated with the ink 40 in the reservoir 10 via a passage 13 at the bottom of the reservoir 10, and the other end fluid communicated with the print ink chamber 50 via an overflow vent 61 which is at a position higher than the ink level of the reservoir 10, a suitable back pressure is applied to the back pressure chamber 60 and the print ink chamber 50 so that, when printing, the increased back pressure at the print ink chamber 50 sucks ink 40 from the reservoir 10 through the overflow vent 61 into the print ink chamber 50; while, when not printing, the extra height of the ink 40 in the back pressure chamber 60 relative to the ink level of the reservoir 10 balances the back pressure at the back pressure chamber 60 and the print ink chamber 50 to prevent ink 41 leaking from the print head 30.

The overflow vent 61 can be a one-way passage made of one-way penetrable film to prevent the ink 40 from flowing into the print ink chamber 50 from the back pressure chamber 60; or a check valve to allow the ink 40 flowing only from the back pressure chamber 60 into the print ink chamber 50.

The ink-jet cartridge 1 is functioned by the principles illustrated in FIGS. 3 and 4. The upper portion of the ink ejector 8 is vacuumed via the suction port 82, while the suction portion 82 is communicated with a U-tube to make the liquid level at the right end 70*b* higher than that at the left end 70*a* to balance the back pressure. The ink reservoir 10 and the back pressure chamber 60 of the ink-jet cartridge 1 resemble the U-tube 7, while the print ink chamber 50 resembles the ink ejector 8.

When printing, the ink 40 is provided from the ink reservoir 10. The ink 40 flows through the passage 13 to the back pressure chamber 60. The ink level at the back pressure chamber 60 is higher than that at the ink reservoir 10 by function of the back pressure in the chamber 60. Therefore, the ink 40 overflows through the overflow vent 61 into the print ink chamber 50 and printed by means of the print head 30.

The functioning of the ink-jet cartridge is as follows:

a) when not printing, the back pressure in the print ink chamber 50 raises the level of ink 40 in the back pressure chamber 60 to the position of the overflow vent 61. In other words, the weight of the ink 40 in the back pressure chamber 60 higher than that at the ink reservoir 10 balances the weight of the ink 41 in the chamber 50 and prevents the ink 41 from leaking through the print head 30; and b) when the ink 41 is ejected to print, the decreased volume of the ink 41 increases the back pressure at the print ink chamber 50 so as to suck the ink 40 into the chamber 50 through the overflow vent 61 from the ink reservoir 10, till the weight of the inks 40, 41 in the two chambers 50, 60 balance.

As a result, the simple structure of the present invention fulfills the demands of ink supply and ink reservation. The ink 40 in the back pressure chamber 60 will be automatically fed into the print ink chamber 50 for printing, and maintains the suitable back pressure in the chamber 50 to prevent ink leakage through the print head 30.

Second Embodiment

Figure 6:
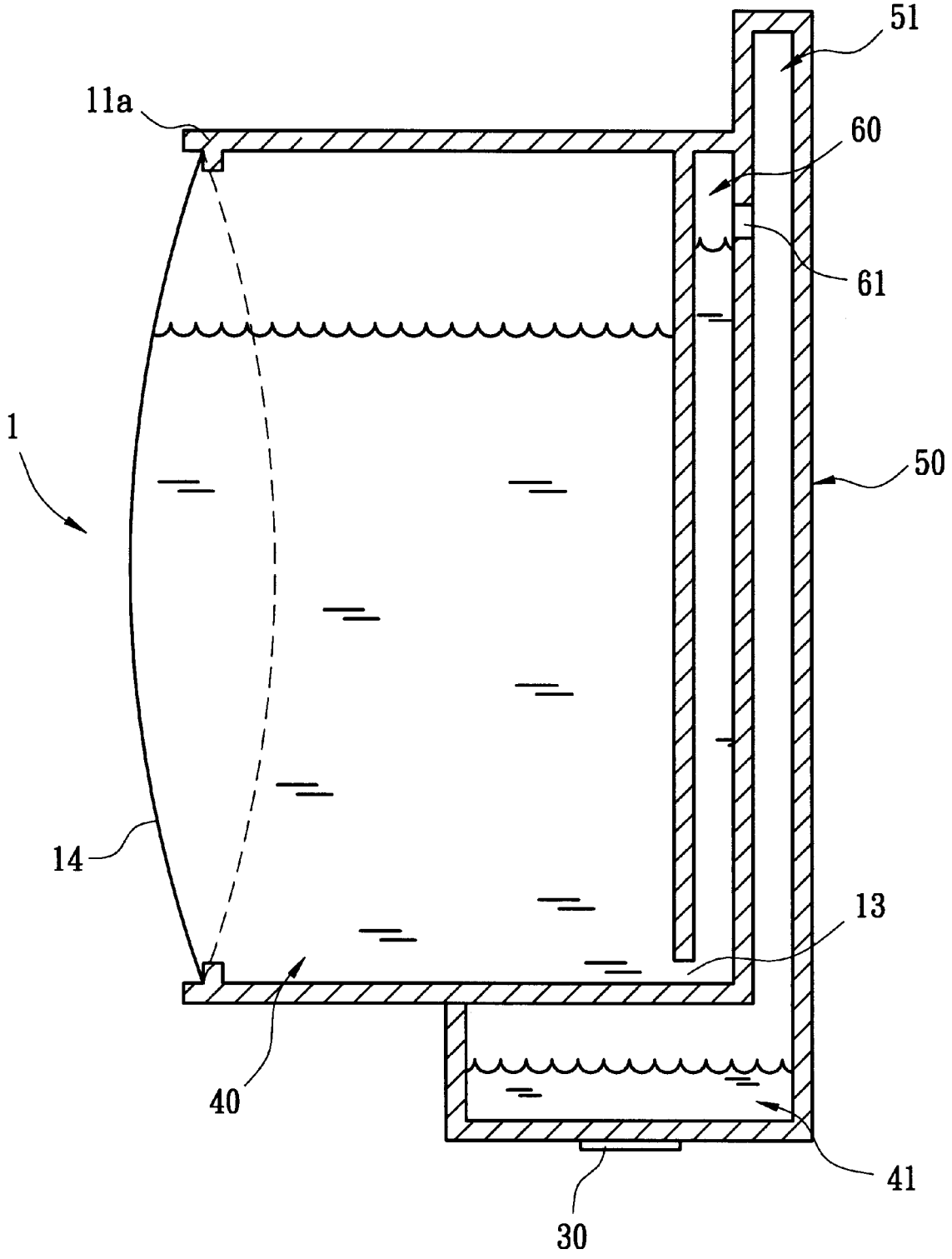
FIG. 6 is a second embodiment of an ink-jet cartridge according to the present invention.

FIG. 6 is a second embodiment of an ink-jet cartridge according to the present invention. The ink-jet cartridge 1 includes:

an ink reservoir 10 for storing ink 40 and providing ink 40 for ejection, the reservoir 10 includes:

an elastic plate 14, made of a membrane material, for deforming itself according to the pressure difference at its two sides;

a rigid body 11*a*, formed with rigid material, having one open side incorporated with the elastic plate 14 to form an ink reservoir 10, for storing ink 40 and decreasing its volume when the pressure at the reservoir 10 lowers;

a print head 30 for ejecting ink 40 and printing;

a print ink chamber 50 for preparing ink ready for the print head 30, the level of ink 41 in the chamber 50 is normally lower than the level of ink 40 in the ink reservoir 10. The chamber 50 is also formed with a room 51 for containing the ink 41 and preventing the ink 41 from flowing back to a back pressure chamber 60 when the ink-jet cartridge is inclined or turned over; and a back pressure chamber 60, having one end fluid-communicated with the ink 40 in the reservoir 10 via a passage 13 at the bottom of the reservoir 10, and the other end fluid-communicated with the print ink chamber 50 via an overflow vent 61 which is at a position higher than the ink level at the reservoir 10.

A suitable back pressure is applied to the back pressure chamber 60 and the print ink chamber 50 so that, when printing, the increased back pressure at the print ink chamber 50 sucks ink 40 from the reservoir 10 through the overflow vent 61 into the print ink chamber 50; meanwhile, the decreased ink 40 increases the back pressure at the ink reservoir 10 which will deform the elastic plate 14 and decrease the volume of the ink reservoir 10. Therefore, the elastic plate 14 compensates the influence of ink usage and enables the ink 40 to be continuously used up.

In conclusion, the ink-jet cartridge according to the present invention has the following advantages:

a) a simple structure for providing ink to the print head chamber without using any valve;

b) a suitable back pressure at the back pressure chamber automatically feeds the ink to the print ink chamber, and prevents ink from leakage through the print head.

While the invention has been described in its preferred embodiments, it is to be understood that the words which have been used are words of description rather than limitation and that changes within the purview of the appended claims may be made without departing from the true scope and spirit of the invention.

What is claimed is:

1. An ink-jet cartridge for providing ink for ejection and preventing ink leakage, the ink-jet cartridge comprising:

an ink reservoir for storing the ink and providing the ink for ejection;

a print head for ejecting the ink and printing;

a print ink chamber for supplying the ink to the print head, an ink level of the print ink chamber normally being lower than the ink level of the ink reservoir; and a back pressure chamber, the back pressure chamber having one end in fluid communication with the ink reservoir and another end in fluid communication with the print ink chamber via an overflow vent, the overflow vent being positioned above the ink level of the ink reservoir, a back pressure being applied to the back pressure chamber and the print ink chamber so that, when printing, an increased back pressure at the print ink chamber sucks the ink from the ink reservoir through the overflow vent into the print ink chamber and when not printing, a height of the ink in the back pressure chamber relative to the ink level of the ink reservoir balances the back pressure at the back pressure chamber and the print ink chamber to prevent ink leakage from the print head.

2. The ink-jet cartridge as recited in claim 1, wherein the ink reservoir comprises:

a rigid body, composed of a rigid material, for storing the ink; and a vent, located on top of the rigid body, the vent being in communication with ambient air for adjusting air pressure inside the ink reservoir.

3. The ink-jet cartridge as recited in claim 2, wherein the vent is a one-way penetrable film through with the ambient air is passable into the reservoir but through which ink fails to leak from the ink reservoir.

4. The ink-jet cartridge as recited in claim 1, wherein the ink reservoir comprises:

an elastic plate having two sides, the elastic plate being made of a membrane material and being deformable according to pressure differences on the two sides thereof; and a rigid body formed with a rigid material, the rigid body having an open side incorporated with the elastic plate to form the ink reservoir for storing the ink and decreasing a volume of the ink reservoir when pressure in the reservoir lowers.

5. The ink-jet cartridge as recited in claim 1, wherein the overflow vent is a one-way passage and is made of one-way penetrable film to prevent the ink from flowing into the print ink chamber into the back pressure chamber.

6. The ink-jet cartridge as recited in claim 1, wherein the overflow vent is a check valve which permits the ink to flow only from the back pressure chamber into the print ink chamber.

7. The ink-jet cartridge as recited in claim 1, wherein the print ink chamber is further formed with a room for containing the ink and preventing the ink from flowing back to the back pressure chamber when the ink-jet cartridge is inclined or turned over.

8. The ink-jet cartridge as recited in claim 1, wherein the ink ejected from the print head is forced by pressurizing means.

9. The ink-jet cartridge as recited in claim 1, wherein the print head cooperates with a heating and vaporizing means during ink ejection.

10. The ink-jet cartridge as recited in claim 1, wherein the ink reservoir, the back pressure chamber and the print ink chamber are all incorporated in a container unit and are separated by two parting plates.

11. The ink-jet cartridge as recited in claim 1, wherein the ink reservoir has a larger volume than the back pressure chamber.

12. The ink-jet cartridge as recited in claim 11, wherein the ink flows from the ink reservoir through the back pressure chamber to the print head such that the ink reservoir is upstream from the back pressure chamber.

13. An ink-jet cartridge for providing ink for ejection and preventing ink leakage, the ink-jet cartridge comprising:

an ink reservoir for storing the ink and providing the ink for ejection, the ink reservoir having an elastic plate made of membrane material, the elastic plate being deformable according to pressure differences on the two sides thereof;

a print head for ejecting the ink and printing;

a print ink chamber for supplying the ink to the print head, an ink level of the print ink chamber normally being lower than the ink level of the ink reservoir; and a back pressure chamber, the back pressure chamber having one end in fluid communication with the ink reservoir and another end in fluid communication with the print ink chamber via an overflow vent, a back pressure being applied to the back pressure chamber and the print ink chamber so that, when printing, an increased back pressure at the print ink chamber sucks the ink from the ink reservoir through the overflow vent into the print ink chamber and when not printing, a height of the ink in the back pressure chamber relative to the ink level of the ink reservoir balances the back pressure at the back pressure chamber and the print ink chamber to prevent ink leakage from the print head.

14. The ink-jet cartridge as recited in claim 13, wherein the overflow vent is positioned above the ink level of the ink reservoir.

15. The ink-jet cartridge as recited in claim 13, wherein the ink reservoir includes a rigid body in addition to the elastic plate, the rigid body having an open side incorporated with the elastic plate to form the ink reservoir for storing the ink and decreasing a volume of the ink reservoir when pressure in the reservoir lowers.

16. The ink-jet cartridge as recited in claim 13, wherein the ink reservoir has a larger volume than the back pressure chamber.

17. The ink-jet cartridge as recited in claim 16, wherein the ink flows from the ink reservoir through the back pressure chamber to the print head such that the ink reservoir is upstream from the back pressure chamber.

18. The ink-jet cartridge as recited in claim 13, wherein the overflow vent is a one-way passage and is made of one-way penetrable film to prevent the ink from flowing into the print ink chamber into the back pressure chamber.

19. The ink-jet cartridge as recited in claim 13, wherein the overflow vent is a check valve which permits the ink to flow only from the back pressure chamber into the print ink chamber.

* * * * *